US005607709A

United States Patent [19]

Fritz et al.

[11] Patent Number: 5,607,709

[45] Date of Patent: Mar. 4, 1997

[54] DISPOSABLE MICROWAVABLE FOOD CONTAINER

[75] Inventors: Jill A. Fritz, Fairport; Darryl P. Hansen, Shortsville, both of N.Y.

[73] Assignee: Tenneco Plastics Company, Evanston, Ill.

[21] Appl. No.: 800,159

[22] Filed: Nov. 27, 1991

[51] Int. Cl.[6] ..... A23L 1/00

[52] U.S. Cl. ..... 426/106; 426/107; 426/118; 426/113; 426/129; 220/260; 220/336.1; 220/669; 220/608; 206/459.5

[58] Field of Search ..... 426/129, 107, 426/118, 113, 106; 220/307, 260, 366; 206/459.5; 219/10.55 E

[56] References Cited

U.S. PATENT DOCUMENTS

| | | | |
|---|---|---|---|
| Re. 32,739 | 8/1988 | Terauds | 426/107 |
| 3,443,720 | 5/1969 | Al-Roy | 220/307 |
| 3,460,711 | 8/1969 | Al-Roy | 220/307 |
| 3,516,852 | 6/1970 | Janssen | 220/260 |
| 3,753,512 | 8/1973 | Curry | 220/260 |
| 3,786,982 | 1/1974 | Rakes et al. | 229/2.5 |
| 3,933,407 | 1/1976 | Tee | 350/61 |
| 4,210,248 | 7/1980 | Engdahl | 426/113 |
| 4,210,674 | 7/1980 | Mitchell | 426/113 |
| 4,341,825 | 7/1982 | Kemski | 428/35 |
| 4,452,356 | 6/1984 | Dahl | 206/631 |
| 4,472,440 | 9/1984 | Bank | 426/118 |
| 4,533,585 | 8/1985 | Holden | 426/129 |
| 4,576,330 | 3/1986 | Schepp | 229/44 R |
| 4,602,719 | 7/1986 | Borst | 220/260 |
| 4,653,685 | 3/1987 | Leary | 426/129 |
| 4,730,731 | 3/1988 | Allison | 206/540 |
| 4,809,868 | 3/1989 | Pomroy | 220/260 |
| 4,863,054 | 9/1989 | Capetta | 220/4 E |
| 4,883,195 | 11/1989 | Ott | 426/118 |
| 4,976,370 | 12/1990 | Cassel | 220/306 |
| 4,991,732 | 2/1991 | La Barge | 220/366 |
| 5,046,659 | 9/1991 | Warburton | 229/2.5 |
| 5,345,069 | 9/1994 | Grindrod | 219/730 |

OTHER PUBLICATIONS

Mobil OPS 5024, 5032 *Deli Containers and Lid.*

*Primary Examiner*—Carolyn Paden
*Attorney, Agent, or Firm*—Arnold, White & Durkee

[57] ABSTRACT

A container for deli food has a base and a removable lid with male and female locking members extending around the periphery thereof. Stiff tabs extend from the periphery of the base and the lid. The tabs are displaced one from the other for easy opening of the container. The tabs are embossed with visual instructions for unlocking, The base of the container is formed of opaque plastic and the lid is clear plastic. The plastic materials are suitable for placing the container in a warming oven and for reheating the food in a microwave oven.

20 Claims, 8 Drawing Sheets

(ENLARGED DETAIL)

DISPOSABLE MICROWAVABLE FOOD CONTAINER

BACKGROUND OF THE INVENTION

The present invention relates to improvements in thermoformed plastic containers for deli food and more particularly, to such a container for packaging pre-prepared foods of the type commonly referred to as "deli foods".

Containers for food or other articles thermoformed from plastic material normally comprise a lid and base which may be hinged to each other or may be separate parts. In order to hold the lid and base of the container in closed condition, it is necessary that the lid and base have a closure which can be manually opened and closed with relative ease. However, the closure should be capable of securely closing the container to avoid accidental opening or leakage of the contents. Containers for deli foods should have a lock which seals against liquid spillage.

Various types of closures have been proposed in the past. Some have included latching or locking structures. For example, cylindrical male and female locking elements have been proposed as disclosed in U.S. Pat. No. 4,576,330. U.S. Pat. No. 4,452,356—Dahl shows a container in which tabs are provided for opening the container. U.S. Pat. No. 5,046,659 is an example of a food container made of clear plastic which presents an attractive appearance for the food, plus a unique locking closure. However, deli foods are most often packaged in foil bags, However, deli foods are most often packaged in foil bags, plastic bags, foil pans with deli overwraps or polystyrene foam trays with overwraps. It is an object of the present invention to improve the presentation of foods in containers which can be used for microwave heating of the contents.

SUMMARY OF THE INVENTION

A thermoformed plastic container used primarily for packaging pre-prepared foods has a base and a domed lid of clear plastic. A closure including a male ridge around the periphery of the flange of the base engages a mating female groove in the flange of the lid. An upwardly extending wall of the cover engages a mating wall on the base to form a tight, double-sealed, liquid-proof seal. This container is unlocked by separating stiff tabs on the lid and the base. The tabs have embossed instructions, such as "HOLD" and "LIFT", to facilitate easy opening of a container which is otherwise tightly sealed.

The container is generally oval in shape with one end rounded and pointed and the other end rounded and flat. The shape of the container conforms generally to the food contained therein, such as a whole roasted chicken. The handles are formed by flat portions at both ends which are inwardly offset with respect to the vertical walls of the base.

The base has a raised bottom with grooves therein so that food can rest on the bottom of the base with the liquid from the food being contained in the grooves. The vertical walls have scallops which add to the rigidity of the base. The base and the clear plastic lid are made of materials such that the packaged food product can be displayed in a warming oven in the store, and then the container can also be used for microwave heating of the contents at home.

The foregoing and other objects, features and advantages of the invention will be better understood from the following more detailed description and appended claims.

SHORT DESCRIPTION OF THE DRAWINGS

DESCRIPTION OF THE PREFERRED EMBODIMENT

Figure 1:
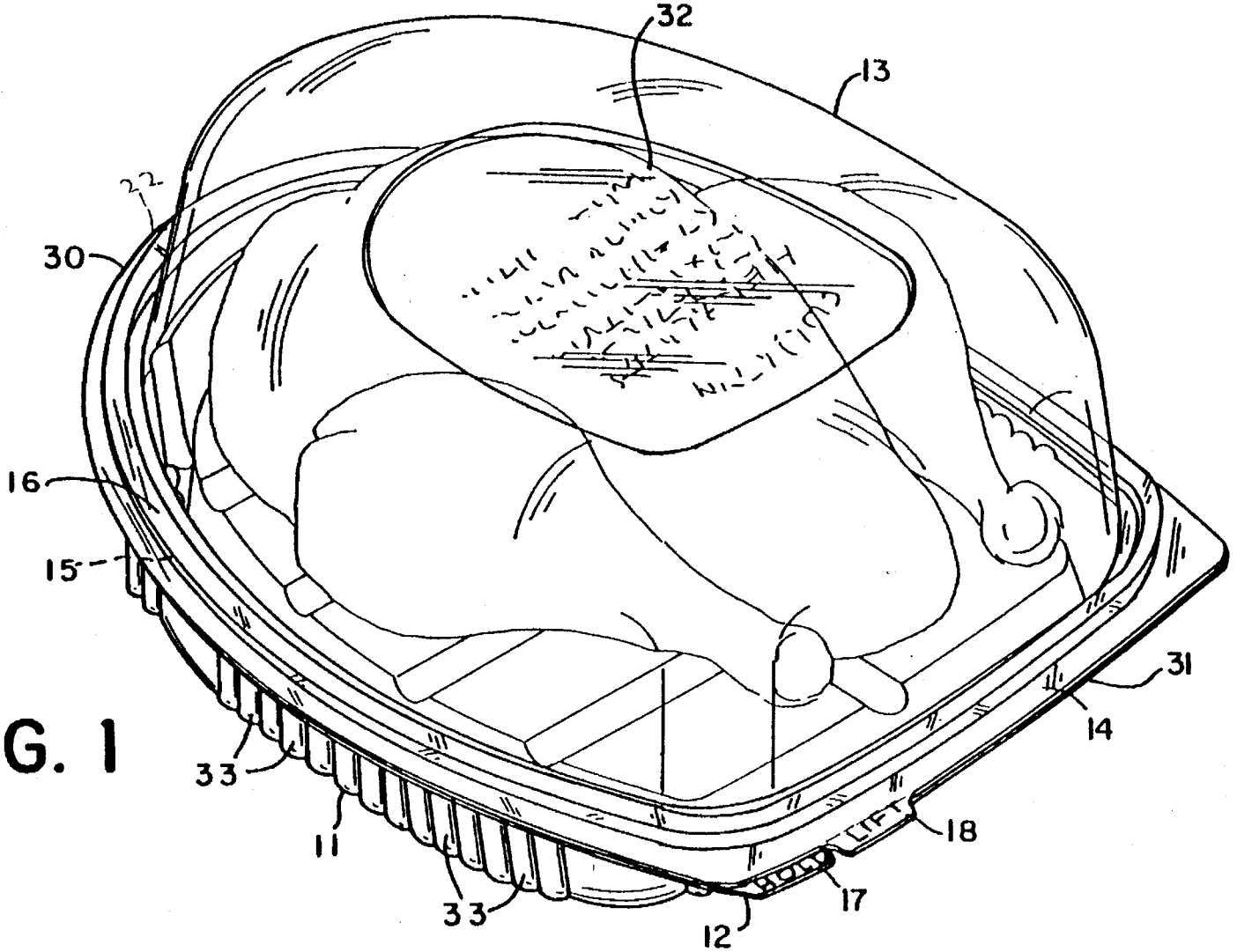
FIG. 1 is a view of the container in the closed position.

A food container has a base 11 with a horizontal flange 12 extending around the periphery thereof. A lid 13 has a horizontal flange 14 extending around the periphery. Flange 14 engages flange 12 when the container is in the closed condition. A male locking member 15 extends around the periphery of the flange 12 on the base. Female locking member 16 is a groove which extends around the periphery of the flange 14 on the lid. Male locking member 15 is slightly smaller than, but fits snugly into, female locking member 16 to form one part of a double seal which will be resistant to leakage.

In order to open the container, a stiff tab 17 extends from the periphery of base 11. A stiff tab 18 extends from the flange of the lid. The tabs are in proximity to one another and slightly displaced from one another. Disengagement of the seal can be accomplished by holding the tab 17 and lifting the tab 18. The instructions "HOLD" and "LIFT" are embossed onto the tabs 17 and 18 respectively. These provide visual instructions for unlocking the container.

The container is generally oval in shape. Handles 25 and 26 are formed in both ends of the container as best shown in FIGS. 9 and 10.

Figure 6:
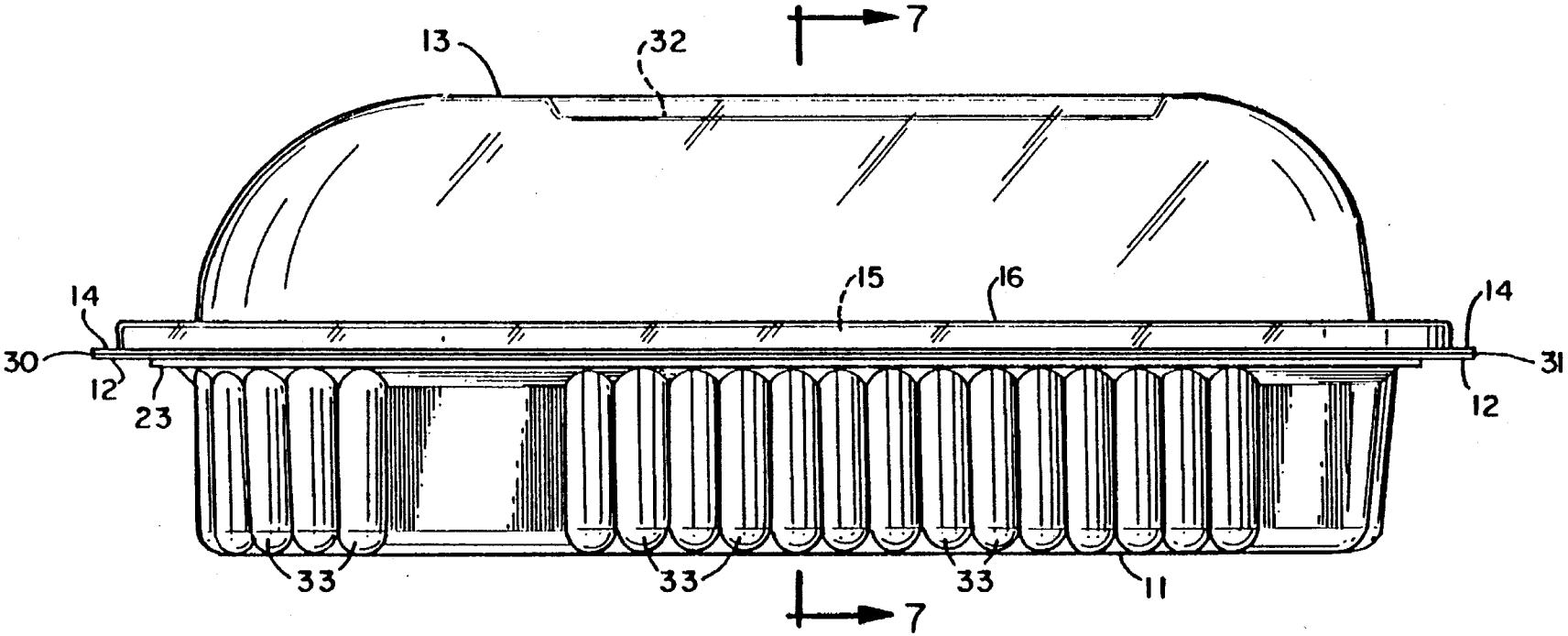
FIG. 6 is a side elevation.
Figure 7:
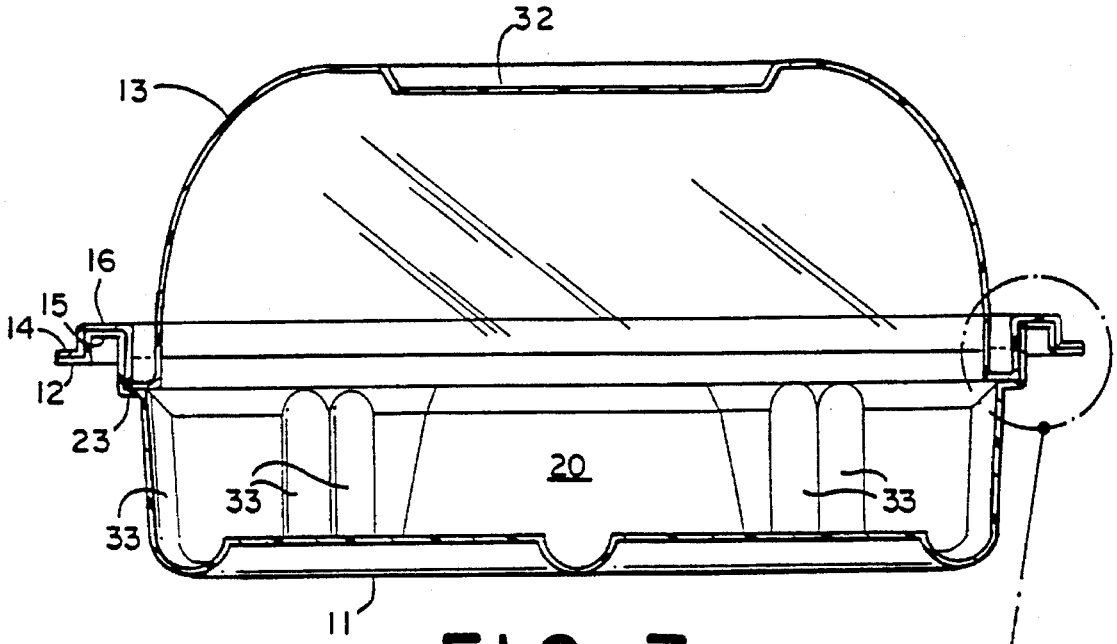
FIG. 7 is a cross-section through the section 7—7 of FIG. 6.

The base 11 has vertical walls with a rim 23 extending between the vertical walls and the flange 12. (FIG. 6). The vertical walls of the base have scallops 33 which add rigidity to the base and make it serviceable for its intended purpose even though the base is thermoformed from relatively thin plastic.

Figure 9:
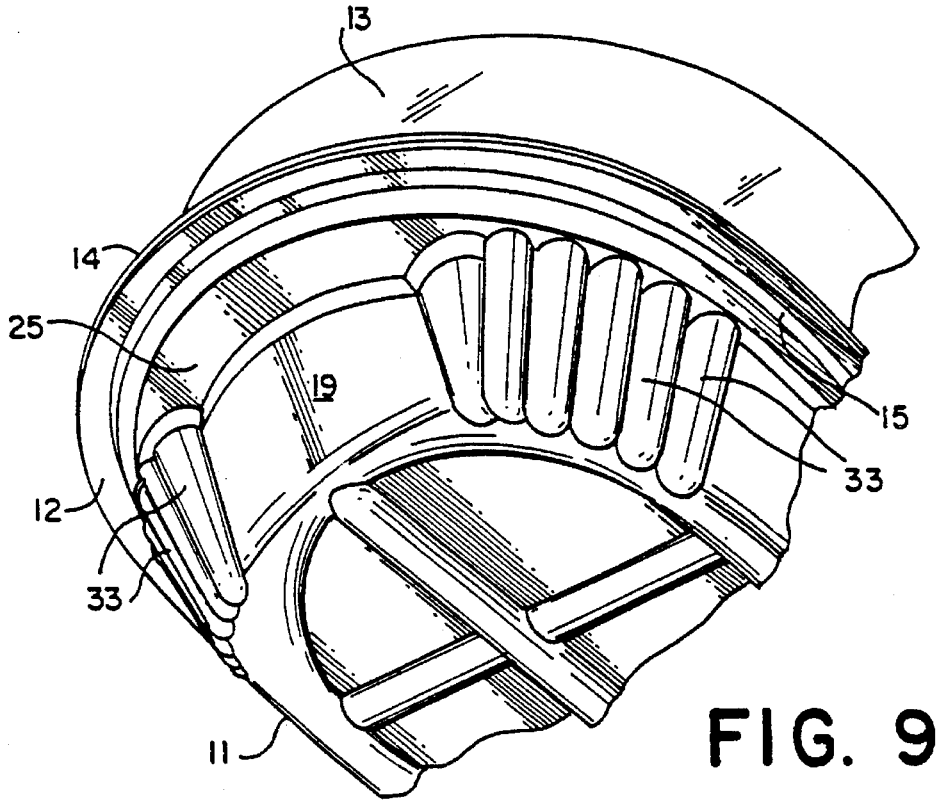
FIG. 9 is an end view of the round pointed end.
Figure 10:
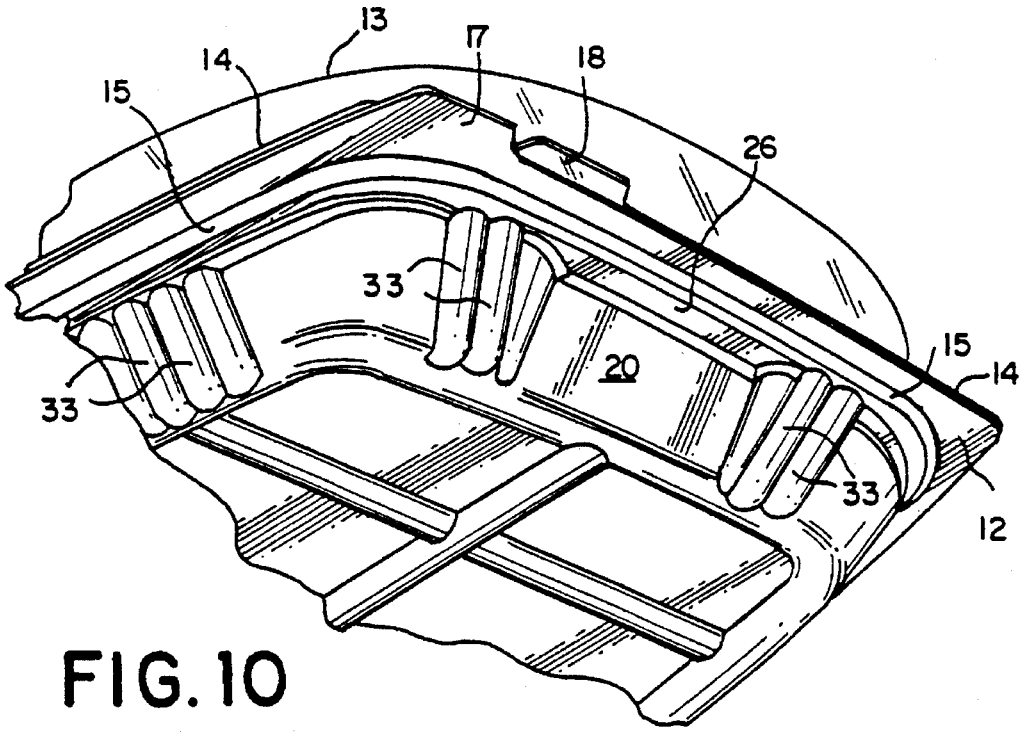
FIG. 10 is an end view of the flat rounded end of the base showing the handle.

The vertical wall, at the flat rounded end of the base, has a flat portion 19 which is offset inwardly with respect to the vertical wall (FIG. 9). Handle 25 is a generally horizontal protrusion which extends between the flat portion 19 and the rim 23. At the other end of the container, a flat portion 20 is offset inwardly with respect to the vertical wall (FIG. 10). The handle 26 is a horizontal protrusion between the flat portion 20 and the rim 23.

Figure 8:
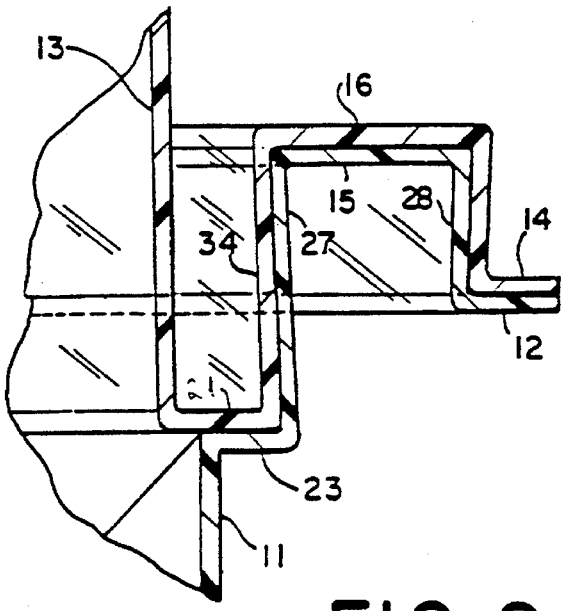
FIG. 8 is an enlarged detail of the seal mechanism.

As shown in FIG. 8, the rim 23 extends upwardly to form one vertical member 27 of the male locking member 15. Vertical member 27 and vertical member 28 of the male locking member extend upwardly and outwardly. Because the male locking member has greater thickness at its topmost portion, it snaps into the groove of the female locking member 16. An upwardly extending vertical member 34 on the lid engages vertical member 27 of the base. This also forms a seal so the container has a double seal. At the bottom of vertical member 34, the lid extends in the horizontal section 21, then extends upwardly from the female locking member into the dome 13. This forms a good liquid-tight seal.

Figure 2:
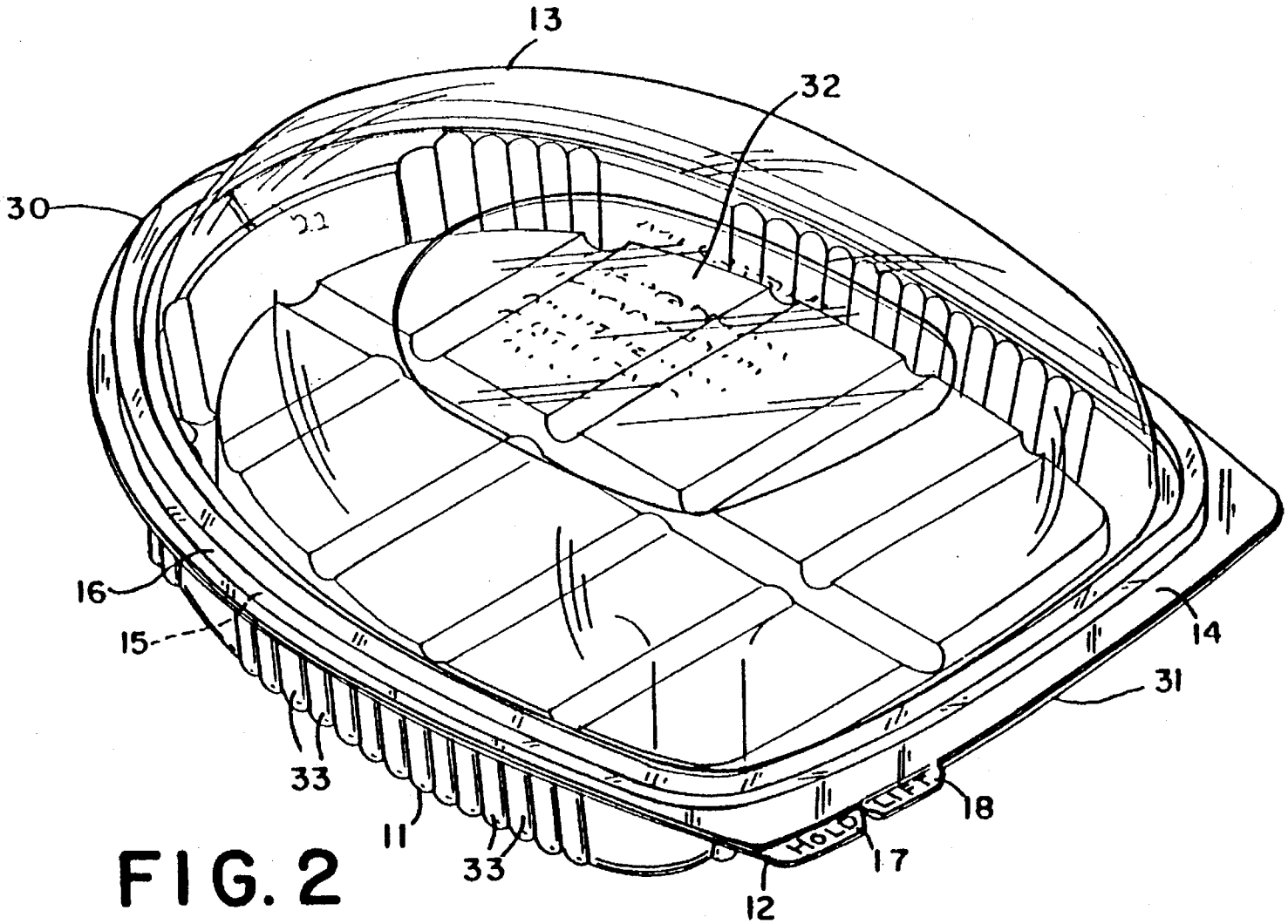
FIG. 2 shows the container with a low dome lid.
Figure 3:
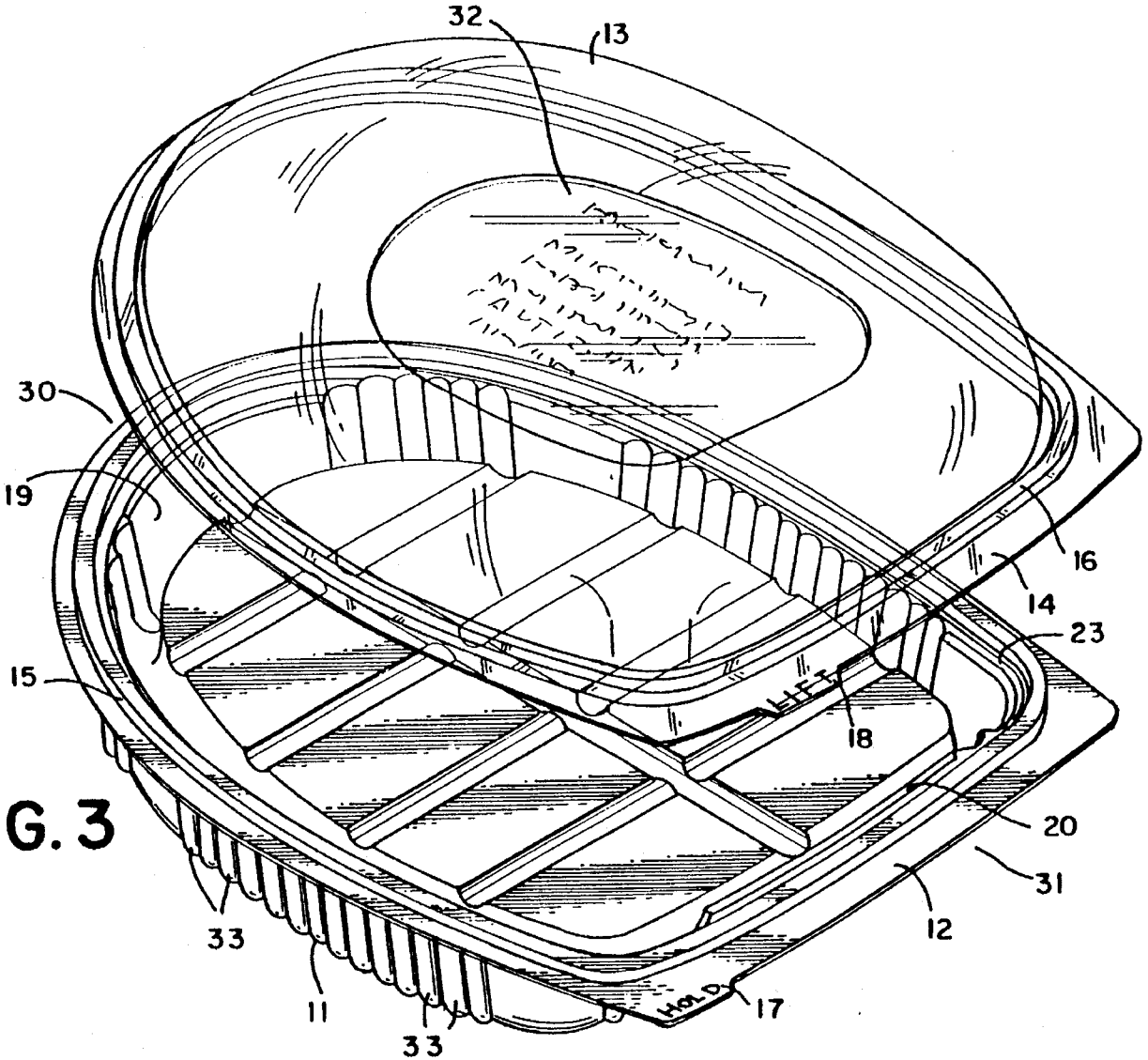
FIG. 3 is a view with the lid removed from the base.
Figure 4:
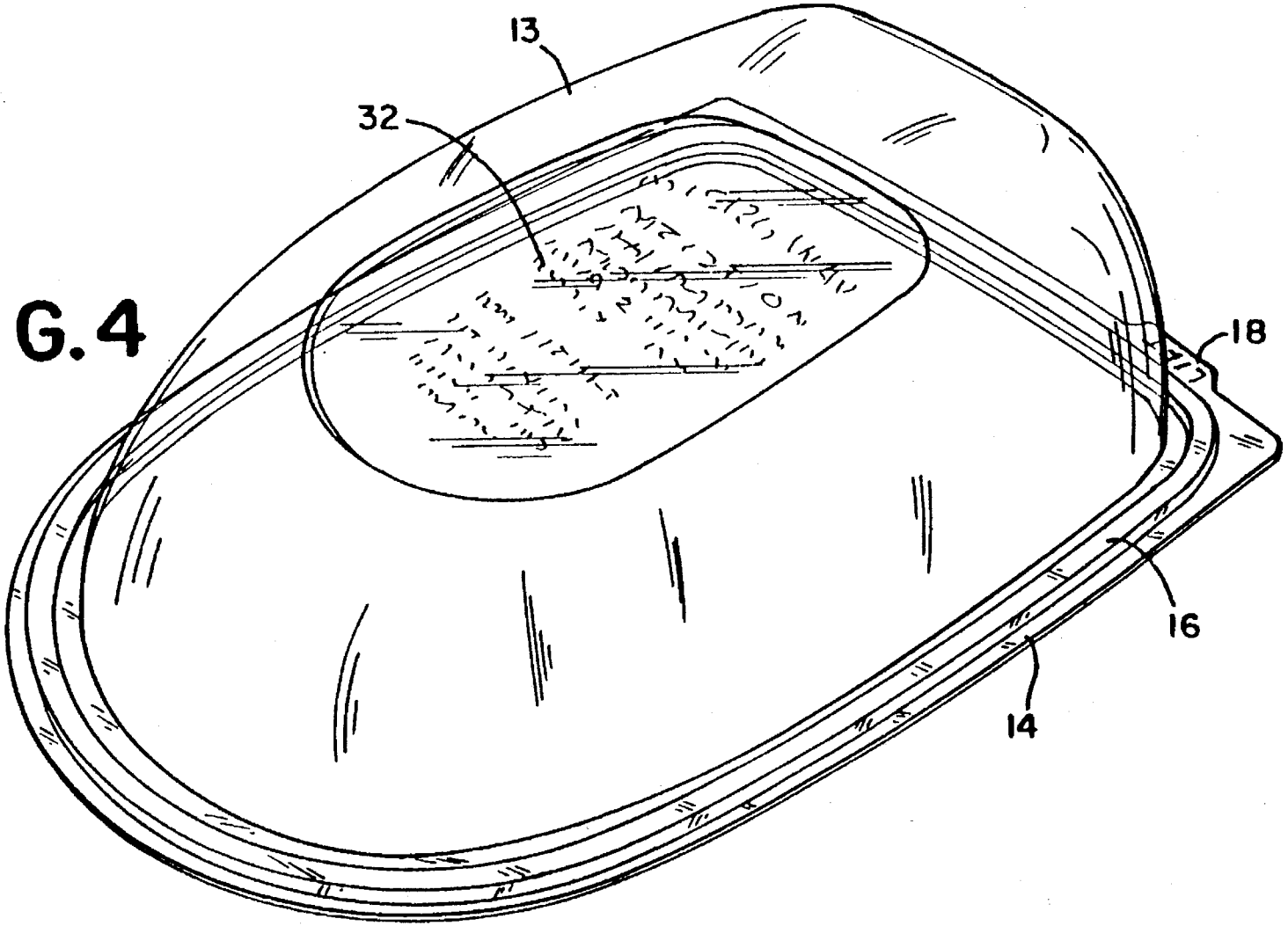
FIG. 4 is a perspective view of the high domed lid in the closed position.
Figure 5:
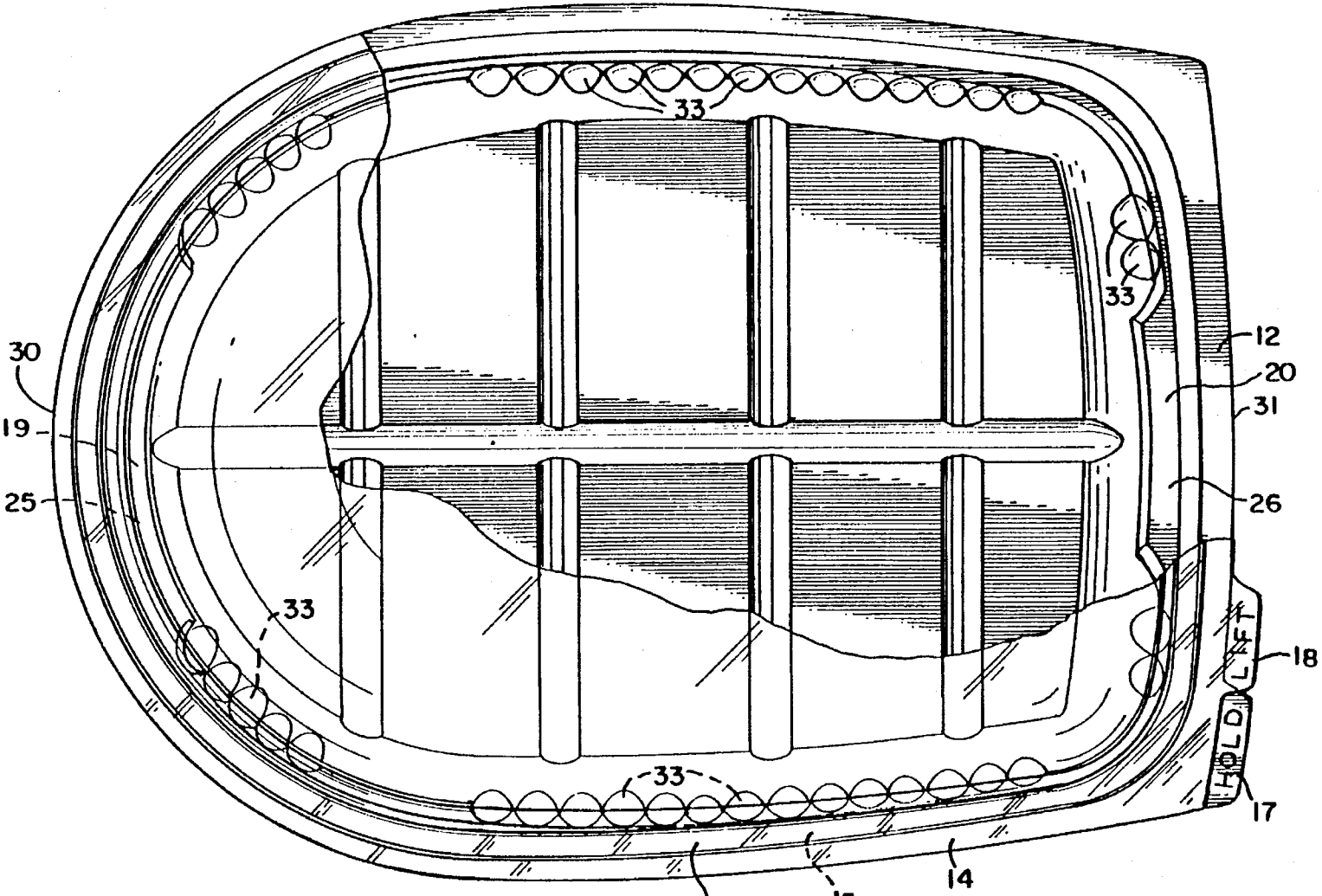
FIG. 5 is a plan view with the lid partially broken away.

The container has a round pointed end 30 and a flat rounded end 31. The oval base and dome lid conform generally to the shape of a whole roasted chicken contained therein to present an attractive appearance for the food. The high dome lid shown in FIGS. 1 and 4 will accommodate a whole cooked chicken and presents an attractive package for the chicken. The flat domed container shown in FIG. 2 is particularly adapted for accommodating cut food parts such as chicken wings or other deli foods.

A flat portion 32 of the lid provides space for embossed cooking instructions. For example, instructions for microwaving the food contained therein may be embossed on the flat portion 32.

The base is made of a microwavable plastic. The dome is made of a material which is suitable for covering foods during warming oven display and microwave heating. The generic materials for the base, and examples thereof, include: talc-filled polypropylene, polypropylene, styrene maleic anhydride (Arco Dylark), polyphenylene oxide/polystyrene (General Electric Noryl) or crystallized polyethylene-terephthalate (CPET). The base is constructed of opaque plastic, whereas the lid is constructed of relatively thin clear plastic. The lid may be made from amorphous polyethyleneterephthalate, oriented polystyrene or styrene maleic anhydride (Arco's Dylark). The clear dome is coated with a suitable anti-fog agent to enhance product visibility during warming oven or refrigerator display While a particular embodiment of the invention has been shown and described, various modifications are within the true spirit and scope of the invention. The appended claims are, therefore, intended to cover all such modifications.

What is claimed is:

1. A container for food or the like comprising:

a relatively thin plastic base having a horizontal flange extending around the periphery thereof;

a relatively thin clear plastic lid having a horizontal flange extending around the periphery thereof and adapted for engagement with the horizontal flange of said base when said container is in a closed condition, said lid being coated with an anti-fog agent to maintain visibility therethrough even when hot food is contained within the container;

a male locking member extending around the periphery of one of said flanges, said male locking member comprising, in cross section, a horizontal linear top surface, a first substantially vertical linear member, and a second substantially vertical linear member, said first and second linear members extending upwardly to intersect said top surface and extending outwardly with respect to each other;

a mating female locking member extending around the periphery of the other flange, said female locking member comprising, in cross section, a horizontal linear top member, a first substantially vertical surface, and a second substantially vertical linear surface, said first and second linear surfaces extending upwardly to intersect said top member and extending outwardly with respect to each other;

a first stiff tab extending from the periphery of said base; and a second stiff tab extending from the flange of said lid, said tabs being in proximity to one another and slightly displaced from one another whereby said second substantially vertical linear surface of said female locking member will be separated from said second substantially vertical linear member of said male locking member when said first and second tabs are relatively displaced.

2. The container recited in claim 1 wherein said tabs are embossed with visual instructions for unlocking.

3. The container recited in claim 1 and a double seal lock which includes said male and female locking members, said female locking member being on said lid, said lid extending upwardly from said female locking member into a dome.

4. The container recited in claim 3 wherein said base has vertical walls with a rim extending between said walls and said flange on said base.

5. The container recited in claim 4 wherein said rim extends upwardly to form said first substantially vertical linear member of said male locking member.

6. The container recited in claim 5 where said lid comprises said first substantially vertical linear surface which engages said vertical linear member of said male locking member.

7. The container recited in claim 4 wherein the vertical wall at both ends of said base has flat portions which are offset inwardly with respect to said vertical walls, said handles being generally horizontal protrusions between said flat portions and said rim.

8. The container recited in claim 4 wherein said vertical walls of said base are scalloped to add rigidity to said base.

9. The container recited in claim 1 wherein said container is generally oval in shape and wherein a handle is formed in both ends of said base.

10. The container recited in claim 9 wherein one end of said oval-shaped container extends to a round point and wherein the other end of said container extends to a flat rounded end.

11. The container recited in claim 9 wherein said container has a squared oval base and a domed lid.

12. The container recited in claim 11 wherein said oval base and said domed lid conform generally to the shape of the food contained therein to present an attractive appearance for said food.

13. The container recited in claim 12 wherein said lid is in the shape of a high dome which will accommodate a chicken or the like.

14. The container recited in claim 12 wherein said lid has a flat dome for accommodating cut food parts.

15. The container recited in claim 11 wherein said domed lid has a flat portion at the top thereof; and cooking instructions embossed upon said flat portion.

16. The container recited in claim 1 wherein the base of said container has a raised bottom with grooves therein, so that said food can rest on the bottom of said base with the liquid from said food being contained in said grooves.

17. The container recited in claim 1 wherein said base is made of microwavable plastics and said dome is made of clear plastic suitable for warming oven display and covering foods during microwave heating.

18. The container recited in claim 17 wherein said microwavable plastics for the base are selected from the group consisting of talc-filled polypropylene, polypropylene, styrene maleic anhydride, polyphenylene oxide/polystyrene or crystallized polyethyleneterephthalate.

19. The container recited in claim 18 wherein said dome materials are selected from the group consisting of oriented polystyrene, amorphous polyethyleneterephthalate, and styrene maleic anhydride.

20. The container recited in claim 1, wherein said base is constructed of opaque plastic.

* * * * *